United States Patent [19]

Lee

[11] 4,057,450

[45] Nov. 8, 1977

[54] METHOD FOR MAKING BUOYANCY MEMBERS

[75] Inventor: George Lee, Monterey Park, Calif.

[73] Assignee: Hitco, Irvine, Calif.

[21] Appl. No.: 755,659

[22] Filed: Dec. 30, 1976

[51] Int. Cl.[2] ..... B29C 13/00; B29D 3/02; B29D 9/10; B29G 7/07

[52] U.S. Cl. ..... 156/213; 156/214; 156/242; 156/267; 264/229; 264/255; 264/263; 264/295; 264/299; 264/309; 264/331; 264/339; 264/271

[58] Field of Search ..... 156/196, 212, 242, 213, 156/267, 44; 264/134, 135, 161, 163, 138, 263, 271, 279, 339, 255, 257, 229, 231, 309, 331, 295, 299

[56] References Cited

U.S. PATENT DOCUMENTS

| | | | |
|---|---|---|---|
| 3,544,104 | 12/1970 | Jenks | 264/229 |
| 3,641,230 | 2/1972 | Jenks | 264/229 |
| 3,962,394 | 6/1976 | Hall | 264/161 |
| 3,970,324 | 7/1976 | Howatt | 156/242 |

*Primary Examiner*—Willard E. Hoag
*Attorney, Agent, or Firm*—Roylance, Abrams, Berdo & Kaul

[57] ABSTRACT

Buoyancy members in the form of a segment of a hollow cylinder are produced by providing a cylindrical mold having two longitudinally extending flanges spaced apart by not more than 180°; forming a layer of fiber-filled uncured polymeric material on the surface of the mold between the flanges, with the layer being continuous, extending over the surfaces of the flanges and including an overhang at the edge of each flange; assembling on the uncured layer a plurality of rigid elongated tubular elements disposed in side-by-side relationship with the assembly of tubular elements filling the angular space between the portions of the layer carried by the flanges; bending the overhand portions of the layer to overlie the corresponding outer edges of the assembly of tubular elements; applying at least one flexible reenforcing member transversely across the assembly of tubular elements with the reenforcing member extending across the flanges and being held under tension; applying a layer of fiber-filled uncured polymeric material over the exposed surfaces of the assembly of tubular elements until the assembly of tubular elements is completely enclosed in a shell of the fiber-filled uncured polymeric material; and curing the polymeric material. The buoyancy members are particularly useful to control the overall buoyancy of subsea risers.

9 Claims, 8 Drawing Figures

METHOD FOR MAKING BUOYANCY MEMBERS

Buoyancy members produced according to the invention are disclosed and claimed in my copending application Ser. No. 755,660, filed concurrently herewith.

BACKGROUND OF THE INVENTION

When, as in subsea well riser applications, it is necessary to provide buoyancy members capable of withstanding large hydrostatic forces and having good resistance to impact, it has been the usual practice to make the buoyancy member in the form of a hollow metal structure or a body of syntactic foam. Buoyancy members so produced have been expensive, excessively heavy in the case of metal structures, and difficult from the standpoint of quality control in the case of syntactic foam bodies. There has accordingly been a continuing need for methods by which buoyancy members could be produced without requiring metal structures or use of syntactic foam.

OBJECTS OF THE INVENTION

A general object is to provide a method for producing buoyancy members using common reenforced plastics fabricating techniques.

Another object is to provide such a method wherein the hollow elements which provide buoyancy can be inspected and tested individually before being incorporated in the structure.

A further object is to devise such a method which provides improved economy, yet produces finished products which are stronger and more resistant to impact than buoyancy members produced, e.g., from syntactic foam.

SUMMARY OF THE INVENTION

The method is based upon the use of an assembly of elongated rigid hollow tubular elements, advantageously pultrusions, and enclosure of that assembly in a water-tight shell. A mandrel-like mold is used which presents a mold surface extending as a portion of a cylinder with two longitudinally extending flanges projecting radially therefrom in locations spaced apart angularly by not more than 180°. As by spray-up procedures, a layer of fiber-filled uncured polymeric material is applied over the mold surface, including the flanges, and the layer is extended to provide overhangs at the outer edges of the flanges. A plurality of the hollow tubular elements are then assembled as a group, side-by-side, to fill the angular space between the portions of the layer carried by the flanges, the tubular elements having substantial flat surfaces and being disposed with flat surfaces of adjacent elements in flush contact. The overhang portions at the edges of the flanges are then turned up to overlie the corresponding outer edges of the assembly of tubular elements. One or more flexible reenforcing members are now applied transversely across the assembly of tubular elements and held in tension. Again as spray-up techniques, an additional layer of fiber-filled uncured polymeric material is now applied to complete a shell which is continuous about the assembly of tubular elements. The polymeric material of the shell is then cured to complete the buoyancy member.

In order that the manner in which the foregoing and other objects are attained according to the invention can be understood in detail, one particularly advantageous embodiment of the method will be described in detail with reference to the accompanying drawings, which form part of the original disclosure of this application, and wherein.

TYPICAL PRODUCT OF THE METHOD

Figure 1:
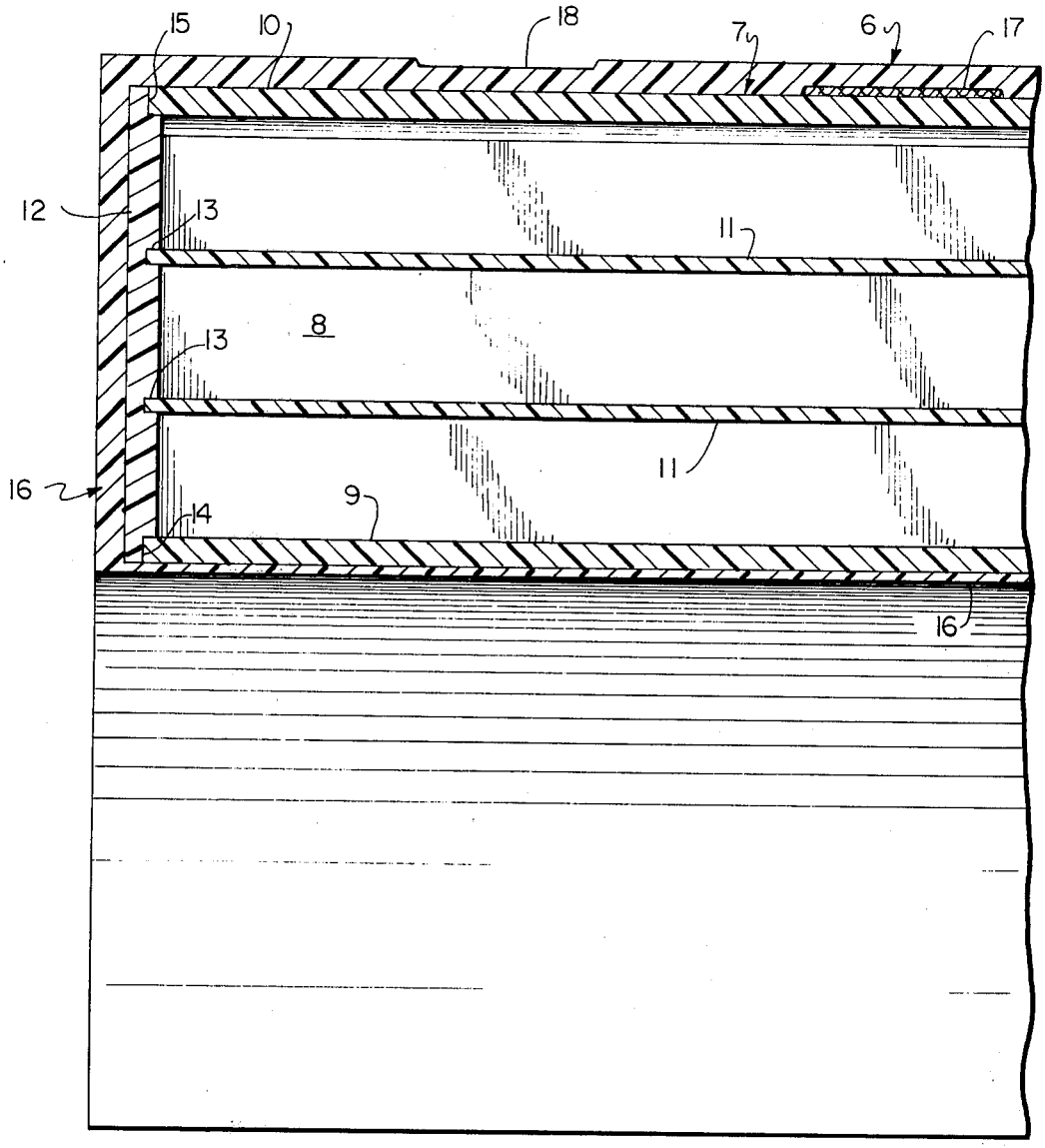
FIG. 1 is a longitudinal sectional view, taken generally on line 1—1, FIG. 2, of one end portion of a typical buoyancy member which can be produced according to the method.

In order that the method can be more readily understood, a typical buoyancy member produced according to the method will first be described with reference to FIGS. 1 and 2. Indicated generally at 6, the buoyancy member comprises a plurality of elongated hollow tubular elements 7, all of which are identical. Each element 7 is an integral rigid straight piece having flat side walls 8, an arcuate inner wall 9, an arcuate outer wall 10, and two partitions 11 which extend longitudinally for the full length of the element and transversely for the full width between side walls 8. At each end, each tubular element 7 is closed by an end cap 12.

The flat side walls 8 of each element 7 diverge from inner wall 9 toward outer wall 10 in such fashion that, if the planes of the two side walls are extended to intersect, any transverse cross-section through the two side walls 8 would define lines which constitute like portions of the equal sides of the isosceles triangle defined by extending the side wall planes. Inner wall 9 and outer wall 10 are concentric.

Figure 2:
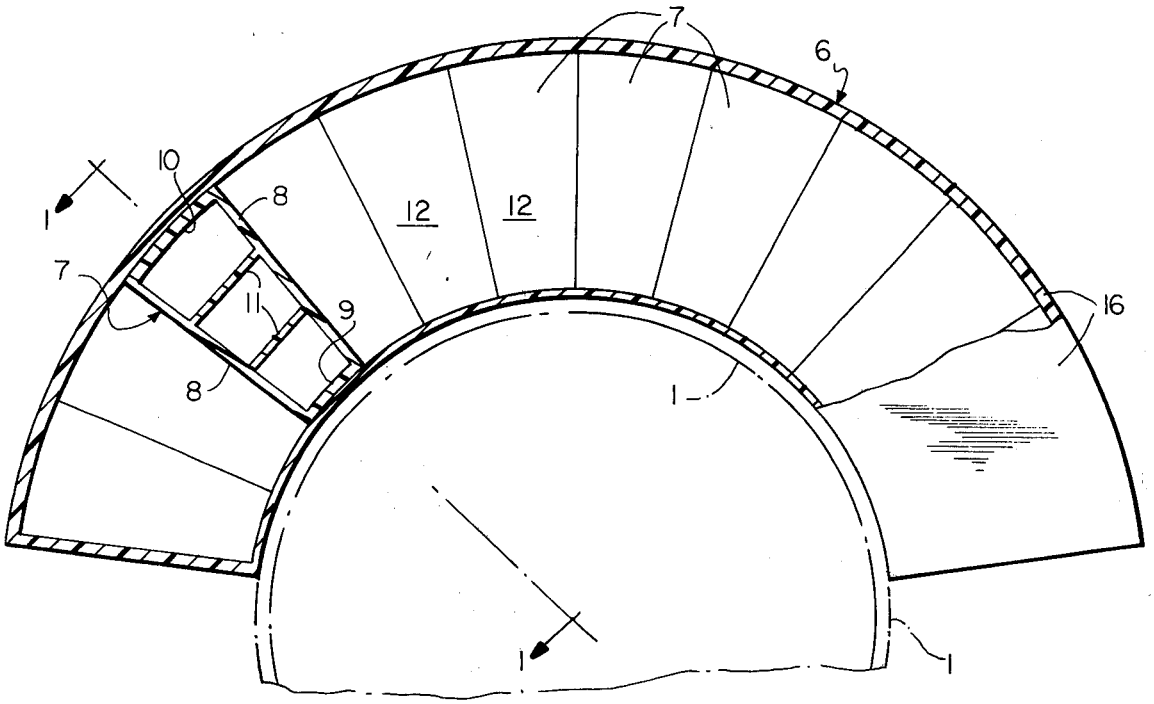
FIG. 2 is an end elevational view of the buoyancy member, with parts broken away for clarity of illustration.

As seen in FIG. 2, the tubular elements 7 are arranged side-by-side, with the adjacent side walls 8 of each adjacent pair of elements 7 being in flush engagement and with the inner walls 9 lying in the same cylindrical plane and the outer walls 10 all lying in a common cylindrical plane. In the completed assembly, all of the side walls 8 lie in planes which are radial with respect to the riser pipe 1, FIG. 2, to which the member is to be applied.

End caps 12 are integral flat pieces provided with straight grooves 13, FIG. 1, to accommodate the ends of partitions 11, and arcuate notches 14, 15 to accommodate the ends of inner wall 9 and outer wall 10, respectively.

The assembly of tubular elements 7 is completely enclosed by a liquid-tight shell 16 which extends completely over and lies in contact with the exposed surfaces of elements 7 and end caps 12. Save for the portion thereof causing walls 9, shell 16 is of significant thickness, typically equal to or of the same order of magnitude as inner walls 9 and outer walls 10 of elements 7. Tension straps 17, FIG. 1, extend over all of the outer walls 10, transversely of the assembly of elements 7, and are completely covered by shell 16. Advantageously, straps 16 are of flexible fabric material. In appropriate locations, typically one near each end of the buoyancy member and one at the midpoint thereof, the outer wall of shell 16 is provided with transverse outwardly opening grooves 18, FIG. 1, to accommodate clamping bands which secure buoyancy member 6 to the riser pipe 1.

While tubular elements 7 can be formed of any suitable material, including light weight metal alloys, it is particularly advantageous from the standpoint of weight, strength and cost to employ elements 7 in the form of pultrusions, i.e., shaped formed by pulling resin-impregnated strands through a shaping die and then through a heating chamber to provide a reenforced polymeric structure of accurately predetermined shape and dimensions, and high tensile strength, compression strength and modulus of elasticity. Employing glass reenforcing strands and polyester resins, elements 7 can be made in the form of pultrusions with tensile and compressive strengths of at least 25,000 lbs. per sq. in. and a modulus of elasticity of at least $1.5 \times 10^6$ lbs. per sq. in.

Water-tight shell 16 is advantageously in the form of a layer of polyester resin filled with chopped glass fibers.

Elements 7 are advantageously pre-coated, as by spraying, with the same polymeric material used to form shell 16, or a polymeric material compatible with the material of the shell, so that the elements 7 are adhered rigidly together in the final assembly. Before such pre-coating, end caps 12 are secured rigidly in place, as by use of a suitable adhesive.

Shell 16, being formed in place, conforms precisely to the assembly of tubular elements 7. Thus, the portion of shell 16 which extends over the inner walls 9 of elements 7 presents a concave cylindrical surface, and this surface is designed to have essentially the same radius of curvature as does the outer surface of riser pipe 1. Accordingly, when the completed buoyancy member is in place on the riser pipe, the inner surface of the buoyancy member is in flush engagement with the outer surface of the riser pipe. The portions of shell 16 which extend over the exposed side walls of the two elements 7 which are at the transverse sides of the groups of tubular elements present flat surfaces conforming to the side walls they cover, and these flat surfaces are spaced apart angularly by less than 180°. Two of the buoyancy members 6 are employed for each length of riser pipe 1, corresponding sides of the two buoyancy members being spaced apart to accommodate the usual kill and choke pipes (not shown). The portion of shell 16 which extends over outer walls 10 of the group of members 7 presents a convex cylindrical surface, and the surface portions constituting the bottoms of groves 18 are accordingly convex cylindrical surfaces to which clamping bands will conform without sharp bends.

In a typical application, for use with a riser pipe having a 20 in. outer diameter, the length of buoyancy members 6 can be 180 in., the dimension of tubular elements 7 radially of the assembly can be 8.38 in., the thickness of the outer layer of shell 16 can be 0.5 in. at grooves 17, and the thickness of the inner layer of the shell can be 0.12 in., so that the diameter of the assembly at the band clamp grooves is 38 in. Each buoyancy member 6 employs twelve tubular elements 7 in the form of glass strand-polyester pultrusions, with side walls 8 being 0.25 in. thick, outer wall 10 0.5 in. thick and partitions 11 0.25 in. thick. Typically, the two buoyancy members can present a net buoyancy of 1600 lbs., as compared to the 1650 lb. weight of the riser pipe.

Elements 7 and end caps 12 can be inspected and tested individually before being incorporated in the structure, thus affording optimum quality control. Similarly, the chopped glass-polyester resin for shell 16 is subject to quality control and its performance can be predetermined with accuracy. Accordingly, the strength characteristics and weight of buoyancy members 6 are more accurately predetermined than, for example, structures produced from syntactic foam. Further, made as hereinbefore described, the buoyancy members 6 have improved resistance to impact and are more economical to produce than devices of the prior art.

DETAILED DESCRIPTION OF THE METHOD

As the first steps of the method, tubular elements 7 are provided, advantageously in the form of pultrusions, and after inspection of the elements 7, each element 7 is closed at both ends by applying end caps 12.

Figure 3:
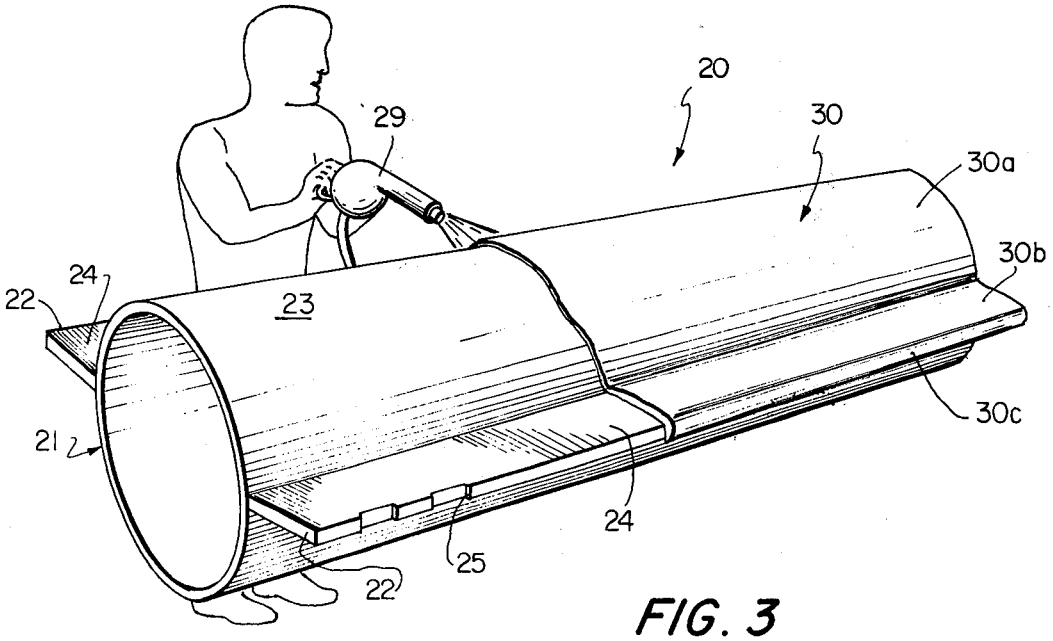
FIGS. 3–7 are fragmentary perspective views illustrating successive steps of the method.
Figure 5:
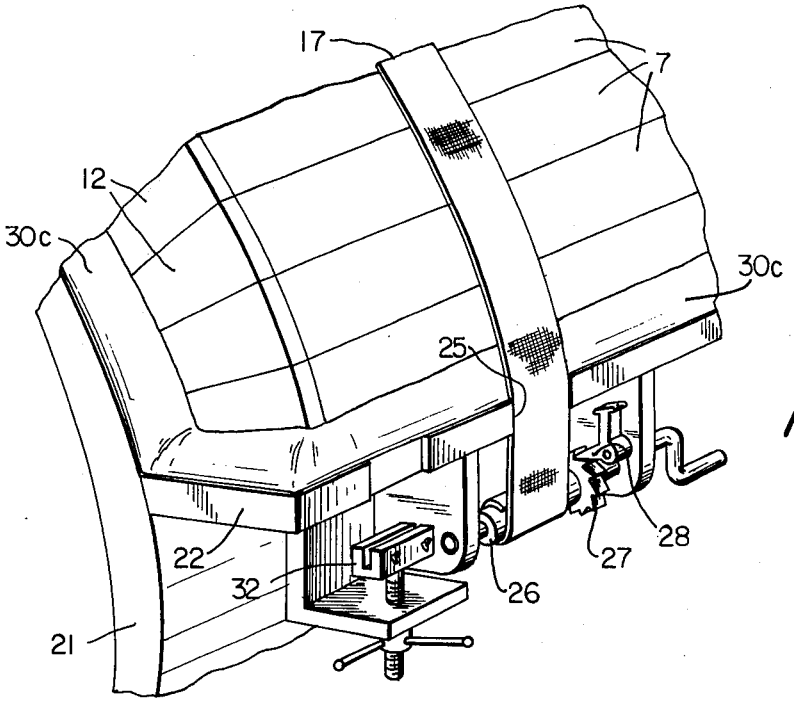

A mold 20, FIG. 3, is employed, typically in the form of a metal cylinder 21 having two longitudinally extending flanges 22 which project outwardly in locations spaced angularly by less than 180°. Flanges 22 are flat and project radially with respect to cylinder 21. Mold 20 thus presents a mold surface comprising the cylindrically extending surface portion 23, between flanges 22, and the flat surfaces 24 presented by flanges 22. Flanges 22 are provided with notches 25 arranged in pairs aligned transversely across the mold. As seen in FIG. 5, a crank-operated reel 26, equipped with a ratchet wheel 27 and stop pawl 28, is provided below each notch 25.

Figure 3A:
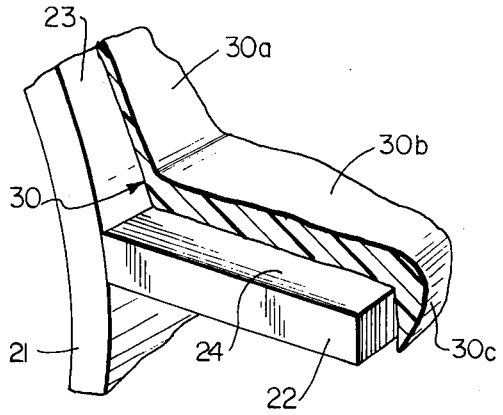

Using a conventional spray gun 29, FIG. 3, and following conventional spray-up practices, a layer 30 of chopped glass fiber-filled uncured polyester resin is applied over the mold surface portions 23 and 24. Advantageously, the portion 30*a* of layer 30 which overlies mold surface portion 23 is made relatively thin, while portion 30*b* which overlie surface portions 24 are made relatively thick. Thus, assuming that the buoyancy member is dimensioned to embrace a riser pipe having an outer diameter of 20 in., portion 30*a* of the layer can be approximately ⅛ in. thick, and portions 30*b* ½ in. thick. Spraying is continued at the outer edges of flanges 22 and at the ends of the flanges and the end portions of cylinder 21 to provide substantial overhang portions 30*c* which constitute an integral part of the layer 30, as seen in FIG. 3A. With the resin uncured, layer 30 is capable of being deformed without damage so that, as later described, overhang portions 30*c* can be displaced by bending.

Figure 4:
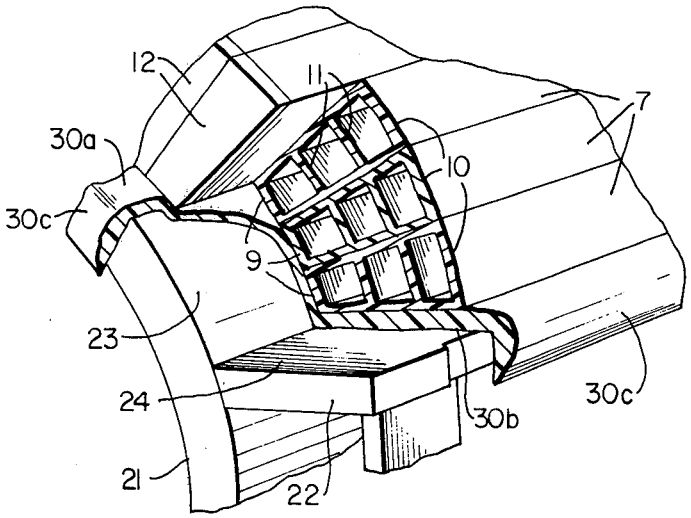

As seen in FIG. 4, the next step of the method is to place the tubular elements 7 on layer 30, with the tubular elements in side-to-side contact and with the inner walls 9 of each element 7 engaging the surface of portion 30*a* of layer 30.

Advantageously, each tubular element 7 is pre-coated with a suitable resin, typically the same curable resin employed for shell 16, before the elements 7 are assembled on the sprayed layer 30.

Overhang portions 30*c* are now turned up manually so as to overlie the adjacent surfaces of the assembly of tubular elements 7, as seen in FIG. 5. Thus, overhang portions 30*c* at the outer edges of flanges 22 are bent to overlie the adjacent portion of outer wall 10 of the element 7 which is nearer the flange 22, while the overhang portions along each end of mold surface 23 are bent up to lie against the adjacent outer surfaces of end caps 12.

Tension straps 17 are now applied, the straps running transversely across outer walls 10 of tubular elements 7 and, as shown in FIG. 5, having their end portions wound on reels 26, the reels being wound to place the straps under a predetermined tension force and that tension being maintained by action of pawls 28 and ratchets 27. Each strap lies in tight flush engagement with the tubular elements and pinches in or indents the portions of overhangs 30*c* crossed by the strap.

Figure 6:
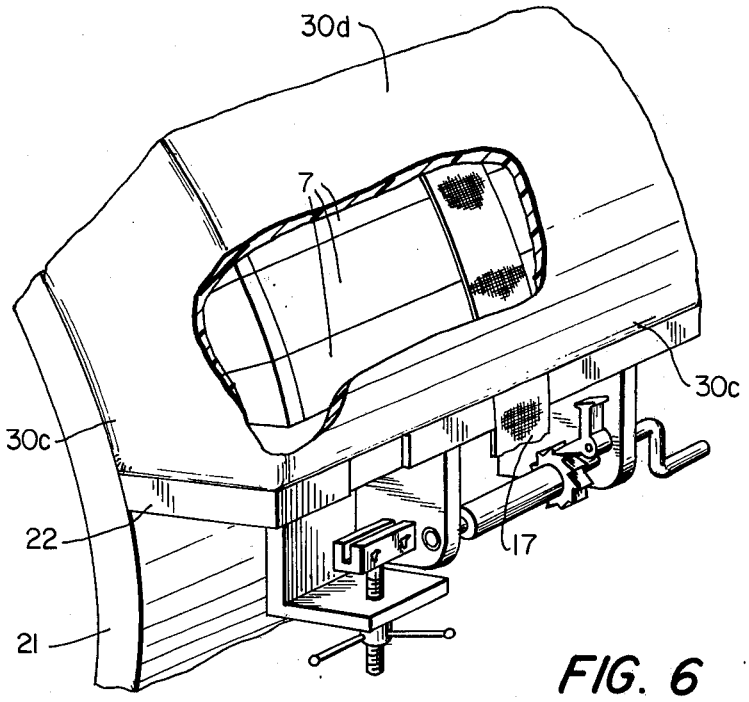

Again using spray gun 29, additional chopped glass filled resin is now sprayed over the exposed surfaces of tubular elements 7, including end caps 12, until the entire assembly of tubular elements is completely enclosed by the sprayed layer of fiber-filled uncured resin, as seen in FIG. 6. The layer 30*d* of sprayed material applied by this step thus joins the turned-up overhang portions 30*c*. The main runs of tension straps 17 are completely covered by the layer 30*d* of sprayed material but, with the end portions emerging as seen in FIG. 6 and still secured by reels 26, the straps remain under tension.

Figure 7:
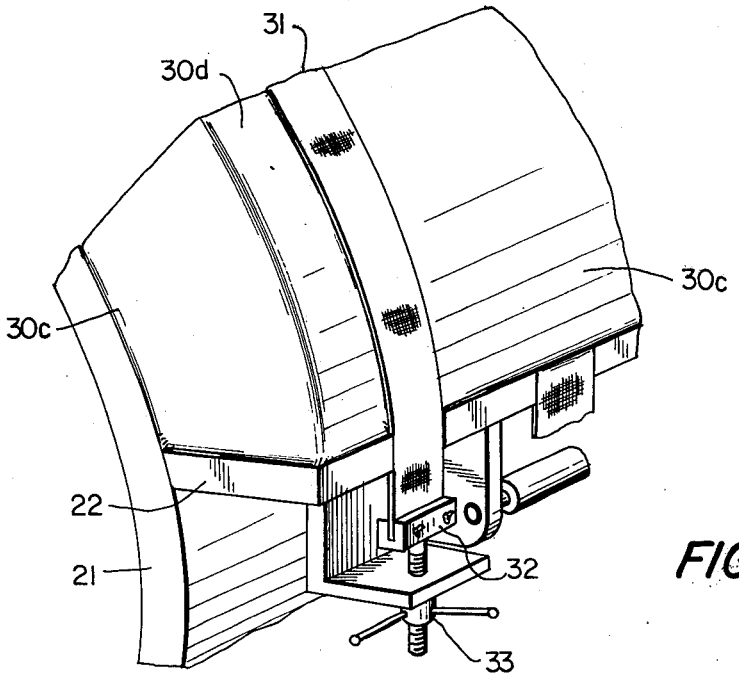

Caul strips 31, FIG. 7, are now applied as seen in FIG. 7, the ends of the strips being secured by clamps 32 and the strips placed under tension by manually operated tension devices 33. The caul strips are made of any suitable material which will not adhere to the fiber-filled resin of layer portions 30*c*, 30*d* during curing. Devices 33 are operated to apply such tension to the caul strips that the strips 31 indent layer portions 30*c* and 30 *d* significantly and uniformly to provide grooves 18, FIG. 1, of uniform depth to accommodate the clamping bands (not shown) which are used to secure the buoyancy members 6 to the riser pipe.

The entire mold assembly, with the completed but uncured buoyancy member 6 thereon, is now transferred into a curing oven and the resin of the sprayed layer thermally cured in known fashion. After curing, the assembly is removed, caul strips 31 taken off, and the exposed ends of tension straps 17 trimmed away to complete the method. The curing step converts sprayed layer portions 30*a*–30*d*, which now form the complete and continuous shell 16, into a rigid, integral, water-tight structure which is highly resistant to impact. Curing also causes the pre-coated elements 7 to be adhered together side face-to-side face.

What is claimed is:

1. A method for producing buoyancy members in the form of a segment of a hollow cylinder, comprising:

forming a bendable, curable layer of fiber-filled polymeric material on exterior surfaces of a cylindrical mold, said mold having two longitudinal, radially extending flanges spaced about its circumference, said surfaces including a surface between said flanges and surfaces of said flanges, said layer terminating in overhanging portions along outer edges of the flanges; assembling on said curable layer a plurality of elongated hollow, rigid, tubular elements in side-by-side relationship to form an assembly with the assembly of tubular elements filling the space between the portions of the curable layer carried by the flanges; bending the overhanging portions of said curable layer to overlie adjacent surface portions of the assembly of tubular elements;

applying at least one flexible reinforcing member transversely across the assembly of tubular elements with the reinforcing member extending across the flanges and being maintained under tension;

applying a layer of fiber-filled curable polymeric material over exposed surfaces of the assembly of tubular elements until the assembly is completely enclosed in a shell of the fiber-filled curable polymeric material, said at least one reinforcing member being enclosed within said shell but having end portions projecting therefrom; and curing the polymeric material of said shell, converting said shell into a rigid, integral structure.

2. A method according to claim 1, wherein said step of forming said layer of fiber-filled curable polymeric material on the mold includes providing overhang portions along the ends of said cylindrical mold and the ends of said flanges;

the method further comprising bending said last-mentioned overhang portions to overlie the ends of said assembly of tubular elements.

3. A method according to claim 1, wherein said tubular elements include closures at both ends.

4. A method according to claim 1, further comprising applying a plurality of longitudinally spaced transversely extending caul strips under tension across the outer surface of said shell before said curing step to form transverse grooves in said shell.

5. A method according to claim 1, wherein said at least one flexible reenforcing member is a flexible strap, the method further comprising trimming away exposed end portions of said flexible strap after said curing step.

6. A method according to claim 1, wherein said tubular elements have flat side surfaces and surface portions of adjacent pairs of said elements are in flush contact.

7. A method according to claim 6, further comprising coating said tubular elements with polymeric material before placing the tubular elements in said assembly, said curing step serving to adhere said tubular elements together.

8. A method according to claim 6, wherein said tubular elements are pultrusions.

said tubular elements are pultrusions.

9. A method according to claim 8, wherein said fiber-filled curable polymeric material is a chopped glass fiber-filled polyester resin material.

* * * * *